US006321922B1

(12) United States Patent
Rumsey et al.

(10) Patent No.: US 6,321,922 B1
(45) Date of Patent: Nov. 27, 2001

(54) COUPLING SHOCK RESISTANT (CSR) COUPLER

(75) Inventors: Steven C. Rumsey, Greer, SC (US); Zoltan Kovacs, Mansfield, OH (US); David S. Preuninger, Greer, SC (US)

(73) Assignee: Westinghouse Air Brake Company, Wilmerding, PA (US)

( * ) Notice: Subject to any disclaimer, the term of this patent is extended or adjusted under 35 U.S.C. 154(b) by 0 days.

(21) Appl. No.: 09/512,487

(22) Filed: Feb. 24, 2000

(51) Int. Cl.[7] ..... B61G 1/22

(52) U.S. Cl. ..... 213/7; 213/40 R; 213/40 D; 213/64

(58) Field of Search ..... 213/7, 37, 40 D, 213/40 S, 50, 51, 61, 62 R, 63, 64, 65; 403/362, 345, 306; 285/322, 404

(56) References Cited

U.S. PATENT DOCUMENTS 1,165,190 * 12/1915 McCord ..... 213/61
3,118,692 * 1/1964 Fitzhugh ..... 285/322
3,968,982 * 7/1976 Belicic ..... 285/287
4,017,139 * 4/1977 Nelson ..... 339/91 R
4,178,023 * 12/1979 Guest ..... 285/323

* cited by examiner

*Primary Examiner*—S. Joseph Morano
*Assistant Examiner*—Frantz F. Jules
(74) *Attorney, Agent, or Firm*—James Ray & Associates

(57) ABSTRACT

A shock-resistant coupler for a vehicle includes a substantially hollow draft gear tube and a coupler head. The draft gear tube has an inside surface, and the coupler head has a flexible, substantially hollow shank portion. The shank portion has a distal end that extends into one end, or mouth, of the draft gear tube. A collar on the distal end features a predetermined number of longitudinally extending relief grooves. Formed in the shank portion adjacent the distal end thereof are at least two slots that extend longitudinally from the collar. These slots enable the distal end of the shank portion to be compressed inwardly so that the shank portion may be inserted into the draft gear tube. A plurality of shear bolts, directed radially through openings in the draft gear tube and corresponding threaded holes in the collar, enable the shank portion to be secured against the inside surface of the draft gear tube. The mouth of the draft gear tube is preferably internally threaded so that an exteriorly threaded ring or bushing, secured about the shank portion between the collar and the coupler head, can be threaded into the mouth to prevent the coupler head from being pulled from the draft gear tube.

6 Claims, 2 Drawing Sheets

FIG.2
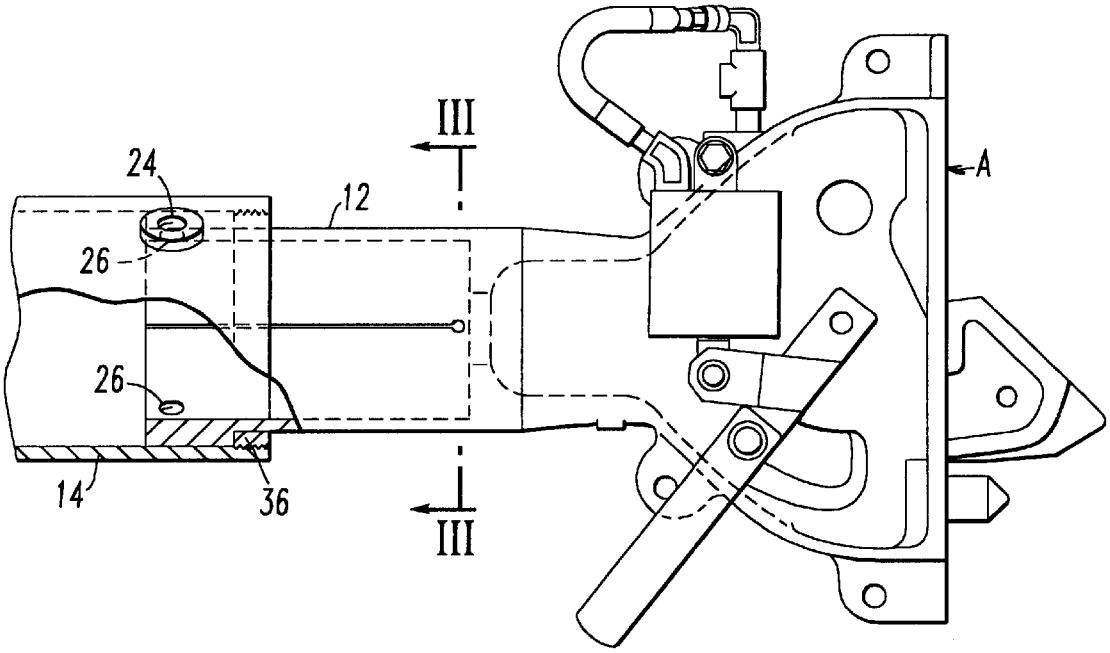
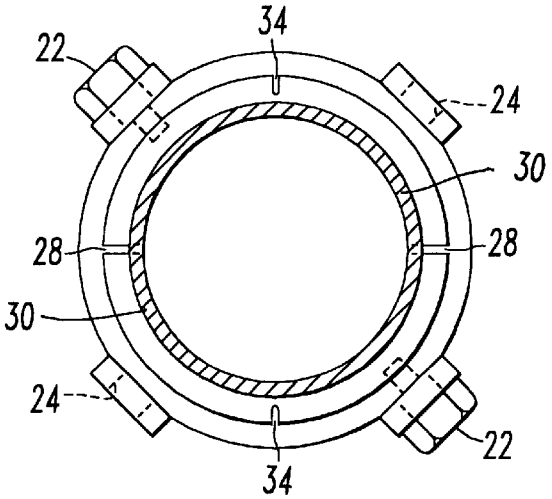
FIG.3

COUPLING SHOCK RESISTANT (CSR) COUPLER

FIELD OF INVENTION

The present invention relates, in general, to vehicular type couplers and, more particularly, this invention relates to robust, flexible type vehicular couplers that provide a substantially equalized shear bolt load and preload under conditions of unequal coupling forces.

BACKGROUND OF THE INVENTION

As is generally well recognized in the railway coupling art, light rail vehicle (LRV) couplers make use of emergency release bolts. These emergency release bolts extend radially through a draft gear tube and into a hollow shank member located behind and extending rearwardly from a coupling head. Such hollow shank member contains an energy absorbing and dissipation means. There is a coupling head disposed on a first LRV car that engages and mechanically couples to a coupling head disposed on a second LRV car. The draft gear tube disposed on each respective car is mechanically secured to the underside of its associated car.

Existing couplers normally employ a rigid hollow coupling head shank portion suspended in a draft gear tube by radially extending shear bolts. These shear bolts are designed to shear and break in two when the coupling forces between two cars which are coupled together exceeds a predetermined coupling load limit, as provided by the strength of the shear bolts.

Normally, the coupling forces that occur when a train of LRV cars is being assembled and connected together for travel with a locomotive, or lead car, exert less load on such shear bolts than the predetermined limit so that the coupling shank/draft gear tube assembly remains intact.

In contrast thereto, hard couplings or collisions between cars will exert loads in excess of the predetermined limit. When this excess load occurs the bolts shear. This allows the coupler shank portion to slide into the draft gear tube and engage and compress the energy dissipation means located in the draft gear tube. As is known in the art, such compression of the energy dissipation means helps to absorb the energy of the collision between the cars by deformation work.

In such existing couplers, the outside diameter of the coupler shank portion is less than the inside diameter of the draft gear tube in order to allow assembly of the two components and travel of such coupler shank portion into the draft gear tube during the above described collision couplings. As such, the shear bolts effect suspension of the coupler shank portion in the draft gear tube. The coupler shank portion and an integral collar do not contact the inside surface of the draft gear tube.

The shear bolts provide all the support for the coupler shank portion and are unevenly loaded when the coupler heads of two LRV cars do not contact each other squarely. An angled contact of the face portions of the coupler heads tend to place the majority of the contacting load on one side of the coupler shank portion and on those shear bolts located on that side. This occurrence can cause such shear bolts to shear prematurely and fatigue more rapidly during normal car couplings.

The above and following description is directed to light rail vehicle (LRV) type coupling, although it is believed the principles of the present invention would be useful in coupling other types of vehicles, particularly, passenger transit type railway vehicles.

BRIEF SUMMARY OF THE INVENTION

The present invention solves the above described problem of uneven coupling forces by providing a coupler tube shank portion with longitudinal slots. Such longitudinal slots permit the wall of the coupler tube shank portion to expand outwardly and engage the inside surface of the draft gear tube when radially extending shear bolts are threaded into the shank wall. This arrangement will place the shear bolts in a virtually pure shear configuration, while engagement of the shank and draft gear walls help to equalize the loads during an angled coupling to provide a more consistent emergency release operation.

In addition, consistent emergency release shear bolt operation is further enhanced by equalizing the torque applied to the shear bolts when they are tightened in the process of assembling the coupler shank portion and draft gear tube components.

OBJECTS OF THE INVENTION

It is, therefore, one of the primary objects of the present invention to provide an improved shock resistant coupler which will substantially equalize uneven coupling forces on shear bolts when vehicles are mechanically coupled together.

Another object of the present invention is to provide an improved shock resistant coupler in which such equalization is achieved in a relatively low cost manner by simply longitudinally slotting the tube of the coupler shank portion to allow the walls of such tube to expand and engage the inside surface of the draft gear tube.

Still another object of the present invention is to provide an improved shock resistant coupler in which such equalization can be enhanced by providing longitudinal relief grooves in a collar that is located at the end of the coupler head shank.

A further object of the present invention is to provide an improved shock resistant coupler in which such slots and grooves can be machined in the shank and collar portions or they can be formed during casting of the shank and collar portions.

Yet another object of the present invention is to provide an improved shock resistant coupler that will equally preload the release bolts when the coupler shank and draft gear tube portions are assembled.

In addition to the various objects and advantages of the present invention that have been discussed in some specific detail above, various other objects and advantages of the invention will become more readily apparent to those persons who are skilled in the relevant art from the following more detailed description of the invention, particularly, when such description is taken in conjunction with the attached drawing Figures and with the appended claims.

BRIEF DESCRIPTION OF THE DRAWINGS

FIG. 2 is a top view, partially longitudinal cross-section, of the assembly illustrated in FIG. 1; and FIG. 3 is a cross-sectional view of the assembly taken along lines III—III in FIG. 2 which illustrates the slots provided in the coupler shank and in a collar of the coupler shank, as well as relief grooves provided in the collar.

BRIEF DESCRIPTION OF A PRESENTLY PREFERRED EMBODIMENT

Figure 1:
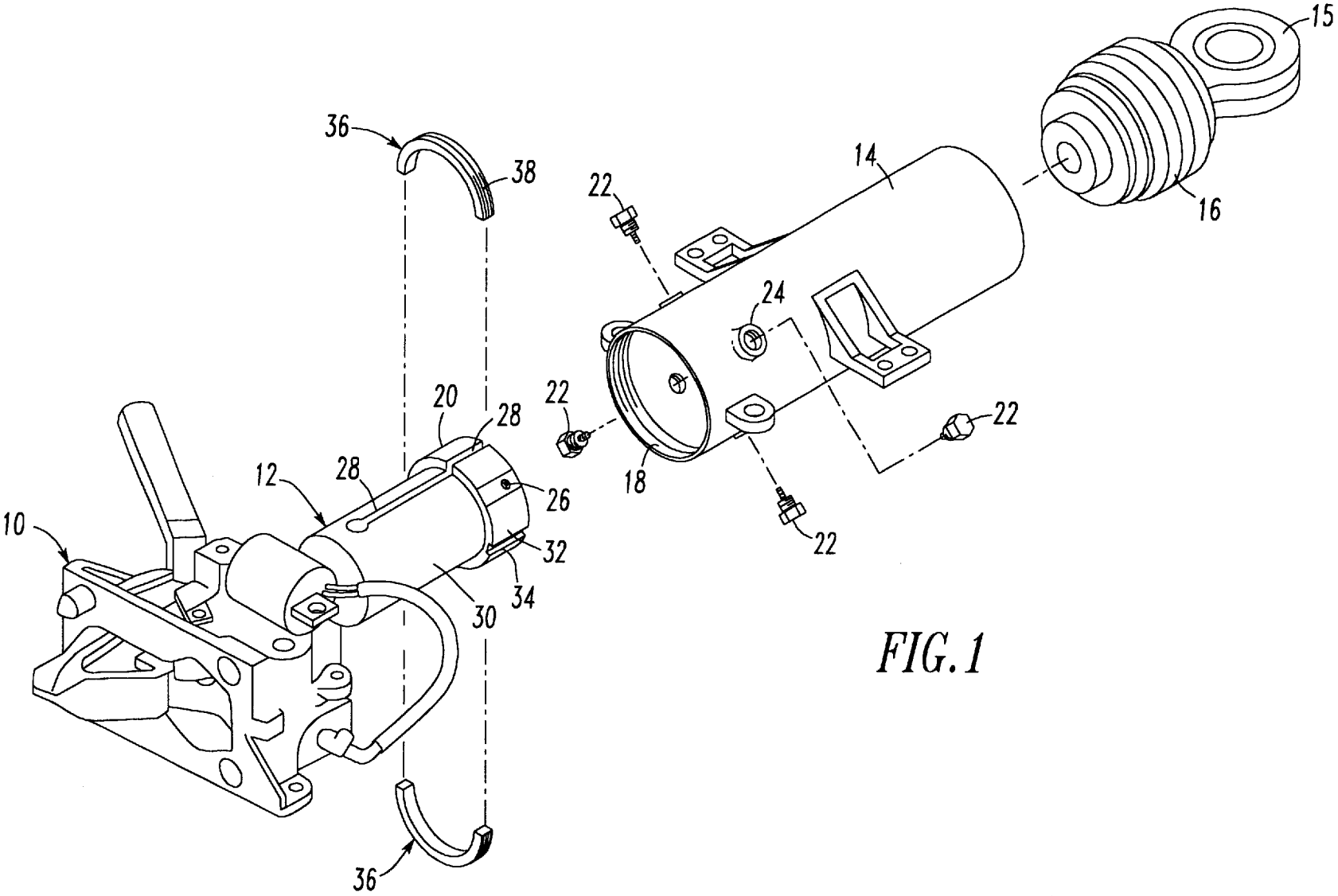
FIG. 1 is an exploded, isometric view of the coupler shank and draft gear assembly according to a presently preferred embodiment of the invention.

Prior to proceeding to the more detailed description of the invention, it should be noted that identical components having identical functions have been identified with identical reference numerals throughout the several Figures illustrated in the drawings, for the sake of clarity and understanding of such invention.

Referring now to FIG. 1 of the drawings, a coupler head 10 and a shank portion 12 of the coupler head 10 are illustrated ready for assembly with a draft gear tube 14. The assembly, preferably, is mechanically connected to the underside of a vehicle (not shown) via a circular bushing 15. Such circular bushing 15 is, also, connected to an energy absorbing and dissipating means 16. Such energy absorbing and dissipating means 16 is disposed for containment within the draft gear tube 14. The draft gear tube 14 has, in addition, a threaded mouth portion 18 located at the forward end of such draft gear tube 14 for the purposes to be discussed in more detail hereinafter.

Shank portion 12 is a substantially hollow tube-like structure provided as an integral part of coupler head 10. The shank portion 12 extends rearwardly from the coupler head 10 and is sized to fit into draft gear tube 14.

An integral collar member 20 is located at the distant end of the shank portion 12, i.e., at the end of the shank portion 12 that is remote from the structure of the coupler head 10. The integral collar member 20 is, also, sized to fit and extend into such draft gear tube 14 and to engage the inside surface of the draft gear tube 14 when a plurality of radially extending shear bolts 22 are threaded into and through threaded openings 24 provided in draft gear tube 14 and into threaded holes 26 provided in integral collar member 20, in a manner presently to be explained.

More particularly, the shank portion 12 and integral collar member 20 are provided with at least two longitudinally extending slots 28. These longitudinally extending slots 28, preferably, form two resilient, flexible spring-like circular wall portions 30 and two circular collar sections 32.

As can best seen in FIG. 2, such longitudinally extending slots 28 are shown diametrically opposed so that the circular wall portions 30 are the same size and diametrically opposed. The number of longitudinally extending slots 28 and circular wall portions 30 are chosen to maintain the strength and integrity of the shank portion 12 and integral collar member 20 while at the same time providing a spring-like resiliency to the circular wall portions 30.

In the process of threading shear bolts 22 into openings 26, shear bolts 22 pull the distal ends of wall portions 30 of the shank portion 12 and the integral collar member 20 toward the inside surface of such draft gear tube 14. With continued rotation of shear bolts 22, the integral collar member 20 is drawn into contact with and engages the inside surface of the draft gear tube 14 thereby stabilizing the integral collar member 20 and shank portion 12 within draft gear tube 14 and placing the shear bolts 22 in a substantially pure shear mode.

The pure shear mode of the shear bolts 22 is further assisted and assured by providing longitudinally extending relief grooves 34 in such integral collar member 20. Such longitudinally extending relief grooves 34 providing the integral collar member 20 with additional flexibility for disposition against the inside surface of the draft gear tube 14. As can be further seen in FIG. 2 of the drawings, the grooves 34 do not extend through the thickness dimension of the integral collar member 20, as is the case with the longitudinally extending slots 28.

In this manner, the integrity of the integral collar member 20 is not compromised, yet the integral collar member 20 has been given the enhanced capability to evenly seat against draft gear tube 14 for a more even stress on shear bolts 22.

In FIG. 2, two grooves 34 are shown diametrically opposed to each other and are located between the longitudinally extending slots 28 at generally equal circumferential distances and angles from such longitudinally extending slots 28.

After the shank portion 12 is inserted into the draft gear tube 14, in the process of assembling together the apparatus of the invention depicted in FIG. 1, a two piece ring or bushing 36 is disposed and secured together about the shank portion 12 and at a location between the integral collar member 20 and such coupling head 10. The outside peripheral surfaces of the two pieces of such ring 36 are threaded at 8 and are sized for threading into the threaded mouth 18 of such draft gear tube 14 when the two pieces of the ring 36 are secured together.

The purpose of ring 36 is to keep the shank portion 12 in the draft gear tube 14 after the shear bolts 22 are sheared from the shank portion 12. This is effected in the present invention by the integral collar member 20 abutting again the ring 36. This allows the vehicle containing the apparatus of the invention to be towed after such shear bolts 22 are sheared in two, because the shank portion 12 will be prevented from being pulled from such draft gear tube 14 by the ring 36.

The vehicle can be towed to a repair shop, for example, for refitting the apparatus of FIG. 1 with new shear bolts 22. The "stub" ends of broken bolts can be removed by hand or by an "easy out" thread extractor. Tapped holes are not damaged when the bolts break so that there is no need to re-tap. In other words, the holes do not need to be retapped for receiving new shear bolts 22.

The threaded ring 36 disposed in the threaded mouth 18 of the draft gear tube 14 permits the ring 36 to be unscrewed from such draft gear tube 14 by use of a peg spanner wrench that engage holes provided in the ring 36. This allows the shank portion 12 and such integral collar member 20 to be removed from the draft gear tube 14 for repair purposes.

When the integral collar member 20 is reconditioned, by removing the release bolt studs, it and shank portion 12 are re-inserted into draft gear tube 14 and new shear bolts 22 are threaded through the openings 24 provided in the draft gear tube 14 and into the openings 26 provided in the integral collar member 20. Ring 36 is now returned to mouth 18 of the draft gear tube 14, with assembly of the invention now being ready for re-use in coupling vehicles together.

While a presently preferred embodiment of carrying out the instant invention has been set forth in detail above, those persons skilled in the vehicle coupling art to which this invention pertains will recognize various alternative ways of practicing the invention without departing from the spirit and scope of patent claims appended hereto.

What is claimed is:

1. A shock resistant vehicular coupler, said coupler comprising:

(a) a substantially hollow draft gear tube having an inside surface;

(b) a coupler head having a substantially hollow shank portion, said substantially hollow shank portion being flexible and having a distal end extending into one end of said substantially hollow draft gear tube, said distal end of said substantially hollow shank portion including a collar, said collar including a predetermined number of longitudinally extending relief grooves provided therein;

(c) at least two longitudinally extending slots formed in said substantially hollow shank portion adjacent said distal end of said hollow shank portion to enable compressing said distal end so that said distal end may be inserted into said draft gear tube; and (d) a predetermined plurality of radially directed shear bolts threaded through said draft gear tube and into said distal end of said substantially hollow shank portion in a manner that secures said substantially hollow shank portion against said inside surface of said draft gear tube.

2. The shock resistant coupler, according to claim 1, wherein said collar includes longitudinal slots that allows said collar to expand and engage said inside surface of said draft gear tube when said shear bolts are threaded into said collar.

3. The shock resistant coupler, according to claim 1, wherein said collar is an integrally formed part of said distal end of said substantially hollow shank portion.

4. The shock resistant coupler, according to claim 1, wherein said coupler further includes means located on said inside surface of said draft gear tube at a location behind said collar to prevent said coupler from being pulled from said draft gear tube when a vehicle containing said coupler is towed after said shear bolts are broken.

5. The shock resistant coupler, according to claim 4, wherein said means for preventing said coupler from being pulled from said draft gear tube is at least one of a ring and a bushing threaded into said draft gear tube.

6. The shock resistant coupler, according to claim 5, wherein said means for preventing said coupler from being pulled from said draft gear tube is a ring threaded into said draft gear tube.

* * * * *